US008464377B1

(12) United States Patent
Carson et al.

(10) Patent No.: US 8,464,377 B1
(45) Date of Patent: Jun. 18, 2013

(54) LINEN FASTENER

(76) Inventors: Michelle Leigh Carson, Wellington, FL (US); Benjamin Craig Carson, Wellington, FL (US)

( * ) Notice: Subject to any disclaimer, the term of this patent is extended or adjusted under 35 U.S.C. 154(b) by 0 days.

(21) Appl. No.: 13/293,519

(22) Filed: Nov. 10, 2011

Related U.S. Application Data

(63) Continuation-in-part of application No. 12/284,152, filed on Sep. 19, 2008, now abandoned.

(51) Int. Cl.
*A47G 9/04* (2006.01)

(52) U.S. Cl.
USPC ..... 5/498; 24/72.5; 24/303

(58) Field of Classification Search
USPC ..... 5/498, 501; 24/303, 114.4, 114.12, 24/72.5
See application file for complete search history.

(56) References Cited

U.S. PATENT DOCUMENTS 4,265,002 A * 5/1981 Hosken ..... 24/303
5,450,658 A * 9/1995 Hicks ..... 24/303
6,163,938 A * 12/2000 Weber-Unger ..... 24/303
6,434,801 B2 * 8/2002 Grunberger ..... 24/303
7,065,841 B2 * 6/2006 Sjoquist ..... 24/303
7,178,185 B1 * 2/2007 Nattler ..... 5/482
7,178,207 B2 * 2/2007 Wong et al. ..... 24/303
7,337,481 B2 * 3/2008 Gilbert ..... 5/494
7,640,636 B2 * 1/2010 Clark ..... 24/303
2007/0124898 A1 * 6/2007 Clark ..... 24/303
2012/0233777 A1 * 9/2012 Hare ..... 5/498
2012/0246828 A1 * 10/2012 Argento ..... 5/486

* cited by examiner

*Primary Examiner* — Michael Trettel
(74) *Attorney, Agent, or Firm* — Simpson & Simpson, PLLC

(57) ABSTRACT

A linen fastener, including: a hub; and a magnet at least partially disposed within the hub. The hub is arranged to be placed against a first exterior surface of layered linens such that magnetic force from the magnet engages an element located on a second exterior surface of the layered linens, opposite the first exterior surface, to clamp the layered linens between the hub and the element. A method of fastening linen using a fastener including a hub and a magnet at least partially disposed within the hub, including: placing the hub against a first exterior surface of layered linens; engaging, with magnetic force from the magnet, an element located on a second exterior surface of the layered linens, opposite the first exterior surface; and clamping the layered linens between the hub and the element.

5 Claims, 3 Drawing Sheets

LINEN FASTENER

CROSS-REFERENCE TO RELATED APPLICATIONS

This is a continuation-in-part patent application under 35 USC 120 of U.S. patent application Ser. No. 12/284,152, filed Sep. 19, 2008, entitled, "BEDBUGZ, THE DUVET STAYS," now abandoned which is incorporated by reference herein.

FIELD OF THE INVENTION

The disclosure relates to a device and method for fastening duvet covers, inserts, and other bed linens.

BACKGROUND OF THE INVENTION

A duvet is a cover, usually a washable cover, that envelops an duvet insert or puff. The combination of a duvet cover and duvet insert or puff may be used in place of a bedspread and top sheet. Hereinafter, the terms "duvet cover" and "duvet" are used interchangeably and the terms "duvet insert" and "insert" are used interchangeably. The duvet cover is made out of fabric, typically sheeting material, and is typically sold separately from a duvet insert. A duvet insert or puff is usually made out of down, down feathers or down alternatives. When the duvet insert is placed inside the cover, the duvet insert is typically unevenly distributed within the cover, for example, the insert shifts and slips within the duvet, resulting in an uneven level of warmth and comfort. To address the uneven distribution, the combination of duvet and insert can be shaken or otherwise manipulated to even out the distribution of the duvet insert within the duvet, for example, to attempt to align the respective corners of the duvet and insert. Given the relatively large sizes of the duvet insert and duvet, this is a very cumbersome and often only partially successful process.

The prior art teaches the use of respective ties on the four corners of a duvet insert for use in connecting the insert to the duvet cover. The principle of operation and the intended use of this arrangement require complimentary loops on the corresponding duvet to which the tie can be connected. However, available duvets typically do not include the complimentary loops, undesirably limiting the use of the insert with corner ties and limiting options available for use with inserts having corner ties. The prior art also teaches the use of clips to clamp a duvet cover and insert together. However, the principle of operation and the intended use of this arrangement require teeth on the clamps that pierce and put holes in the fabric of the duvet or insert. Also, the clips are typically large and of odd shape and interfere with the use of the duvet and insert.

BRIEF SUMMARY OF THE INVENTION

The present disclosure broadly comprises a linen fastener, including: a hub; and a magnet at least partially disposed within the hub. The hub is arranged to be placed against a first exterior surface of layered linens such that magnetic force from the magnet engages an element located on a second exterior surface of the layered linens, opposite the first exterior surface, to clamp the layered linens between the hub and the element.

The present disclosure also broadly comprises a duvet cover fastening assembly, including a first duvet cover fastener with a first hub having: a first stem; a first cavity within the first stem; and a first lip extending from the first stem. The first fastener includes a first magnet disposed within the first cavity. The assembly includes a second duvet cover fastener with a second hub having: a second stem; a second cavity within the second stem; and a second lip extending from the second stem. The second fastener includes a second magnet disposed within the second cavity. The first duvet cover fastener is arranged to be placed against a first exterior surface of a duvet cover encasing a duvet insert. The second duvet cover fastener is arranged to be placed against a second exterior surface of the duvet cover such that the first and second magnets are drawn toward each other by respective magnetic forces to clamp the duvet cover and duvet insert between the first and second duvet cover fasteners.

The present disclosure further broadly comprises a method of fastening linen using a fastener including a hub and a magnet at least partially disposed within the hub, including: placing the hub against a first exterior surface of layered linens; engaging, with magnetic force from the magnet, an element located on a second exterior surface of the layered linens, opposite the first exterior surface; and clamping the layered linens between the hub and the element.

BRIEF DESCRIPTION OF THE DRAWINGS

The nature and mode of operation of the present disclosure will now be more fully described in the following detailed description of the disclosure taken with the accompanying drawing figures, in which.

DETAILED DESCRIPTION OF THE INVENTION

At the outset, it should be appreciated that like drawing numbers on different drawing views identify identical, or functionally similar, structural elements of the disclosure. While the present disclosure is described with respect to what is presently considered to be the preferred aspects, it is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure, which is limited only by the appended claims.

Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the preferred methods, devices, and materials are now described.

Figure 1:
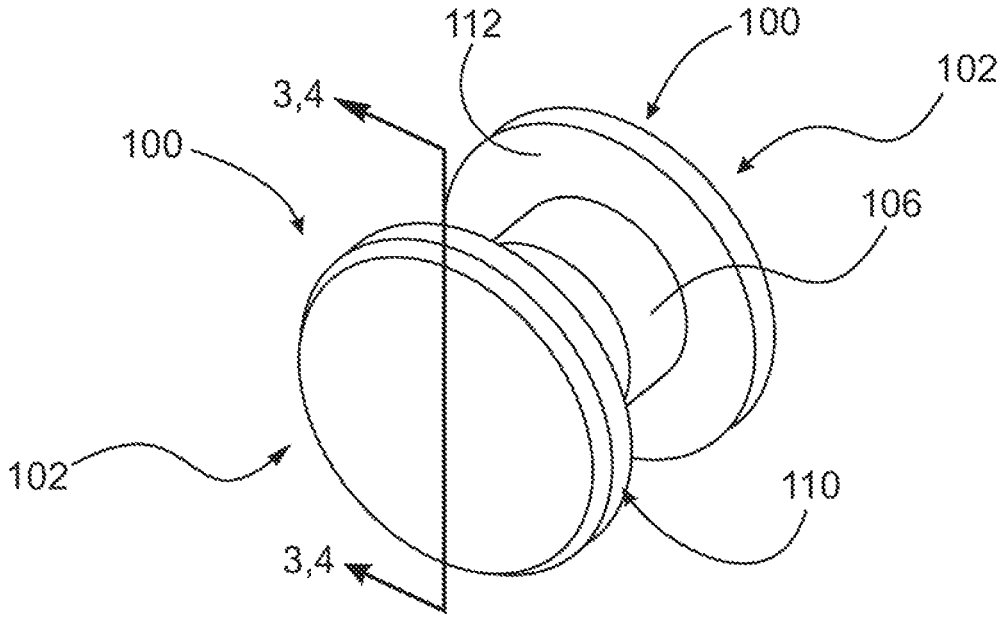
FIG. 1 is a perspective view of two linen fasteners.

FIG. 1 is a perspective view of two linen fasteners 100.

Figure 2:
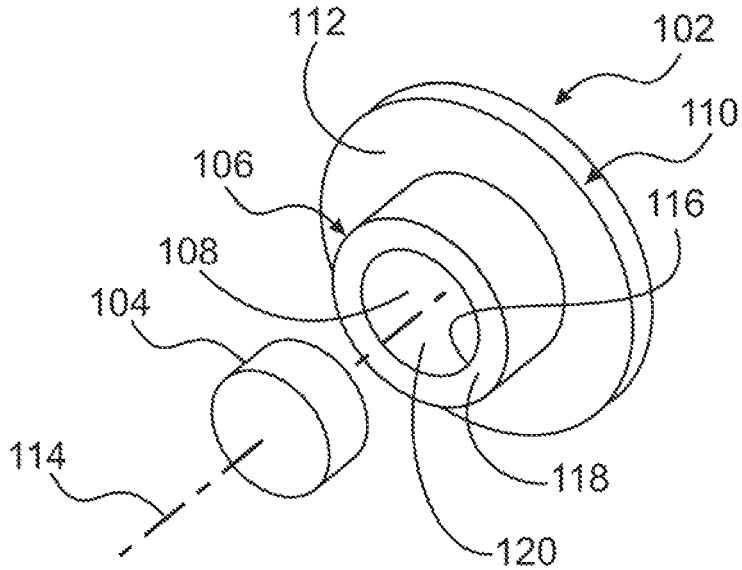
FIG. 2 is an exploded view of a linen fastener shown in FIG. 1.

FIG. 2 is an exploded view of a fastener 100 shown in FIG. 1.

Figure 3:
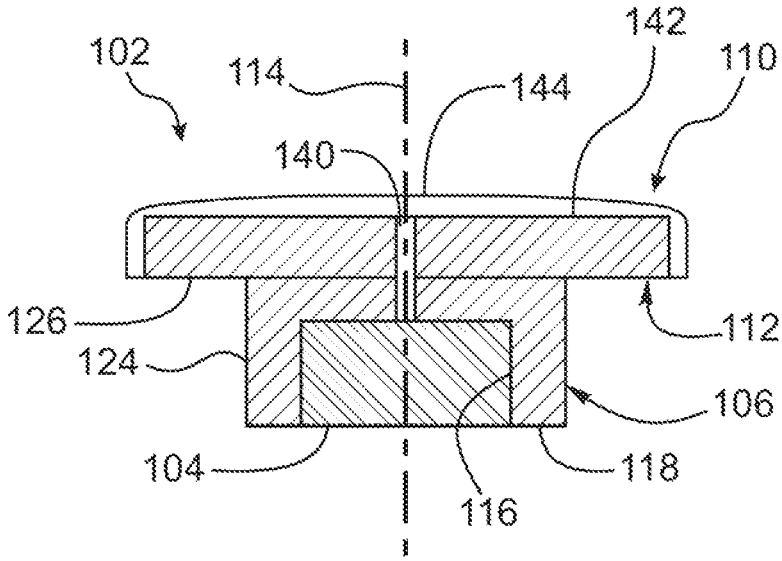
FIG. 3 is a cross sectional view of a linen fastener shown in FIG. 1, generally along line 3,4-3,4 in FIG. 1.

FIG. 3 is a cross sectional view of a fastener 100 shown in FIG. 1, generally along line 3,4-3,4 in FIG. 1. The following should be viewed in light of FIGS. 1 through 3. Fastener 100 includes at least one hub 102 with at least one magnet 104 at least partially disposed within the hub. As further described below, the hub is arranged to be placed against an exterior surface of layered linens such that magnetic force from the magnet engages an element located on an opposite exterior surface of the layered linens to clamp the layered linens between the hub and the element. In one embodiment, the element is any magnet material. In one embodiment, the element is another fastener 100 as described below. By "layered linens" we mean any combination of bed linens known in the art, for example, any combination of sheets, blankets, comforters, duvet cover, duvet insert, or other coverings placed one upon the other.

In one embodiment, hub 102 includes stem 106, cavity 108 formed by the stem, and cap 110. The cap includes lip 112 extending from the stem. The magnet is at least partially disposed within the cavity, and the stem is arranged to be placed against the exterior surface of the layered linens.

In one embodiment, fastener 100 includes longitudinal axis 114 passing through the cavity and stem 106 includes at least one axial surface 116 (for a shape in which the surface is flat) or at least one circumferential surface 116 (for a shape in which the surface is curved/cylindrical), and distal surface 118. Surface 116 is substantially parallel to the longitudinal axis and forms at least a portion of the cavity. In one embodiment, the cavity includes opening 120 formed by surface 116. Distal surface 118 is substantially orthogonal to the longitudinal axis and continuous with surface 116. By "substantially parallel" and "substantially orthogonal" we mean that the surfaces in question are intended to be parallel or orthogonal within reasonable tolerances, although it should be understood that some variance for technical or aesthetic purposes is possible. Distal surface 118 is arranged to be placed against the exterior surface of the layered linens.

Figure 4:
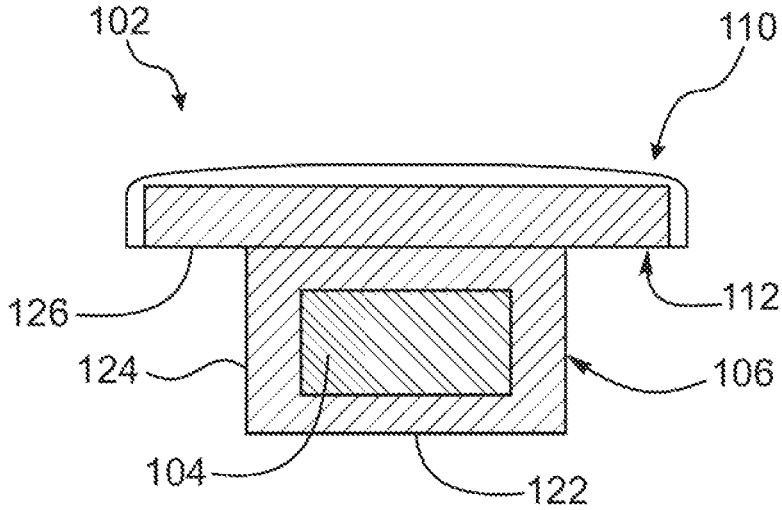
FIG. 4 is a cross sectional view of a linen fastener shown in FIG. 1 with an enclosed cavity, generally along line 3,4-3,4 in FIG. 1; and, FIG. 5 is a side view of a linen fastening assembly in use.

FIG. 4 is a cross sectional view of a linen fastener shown in FIG. 1 with enclosed cavity 108, generally along line 3,4-3,4 in FIG. 1. In one embodiment, the cavity is at least partially enclosed by side 122 of the stem. In FIG. 4, side 122 fully encloses the cavity; however, it should be understood that side 122 could only extend over a portion of opening 120.

The following should be viewed in light of FIGS. 1 through 4. In one embodiment, the stem includes at least one axial surface 124 (for a shape in which the surface is flat) or at least one circumferential surface 124 (for a shape in which the surface is curved/cylindrical), substantially parallel to the longitudinal axis and facing away from the longitudinal axis, and the lip includes radial surface 126 substantially orthogonal to the longitudinal axis and extending from surface 124.

Figure 5:
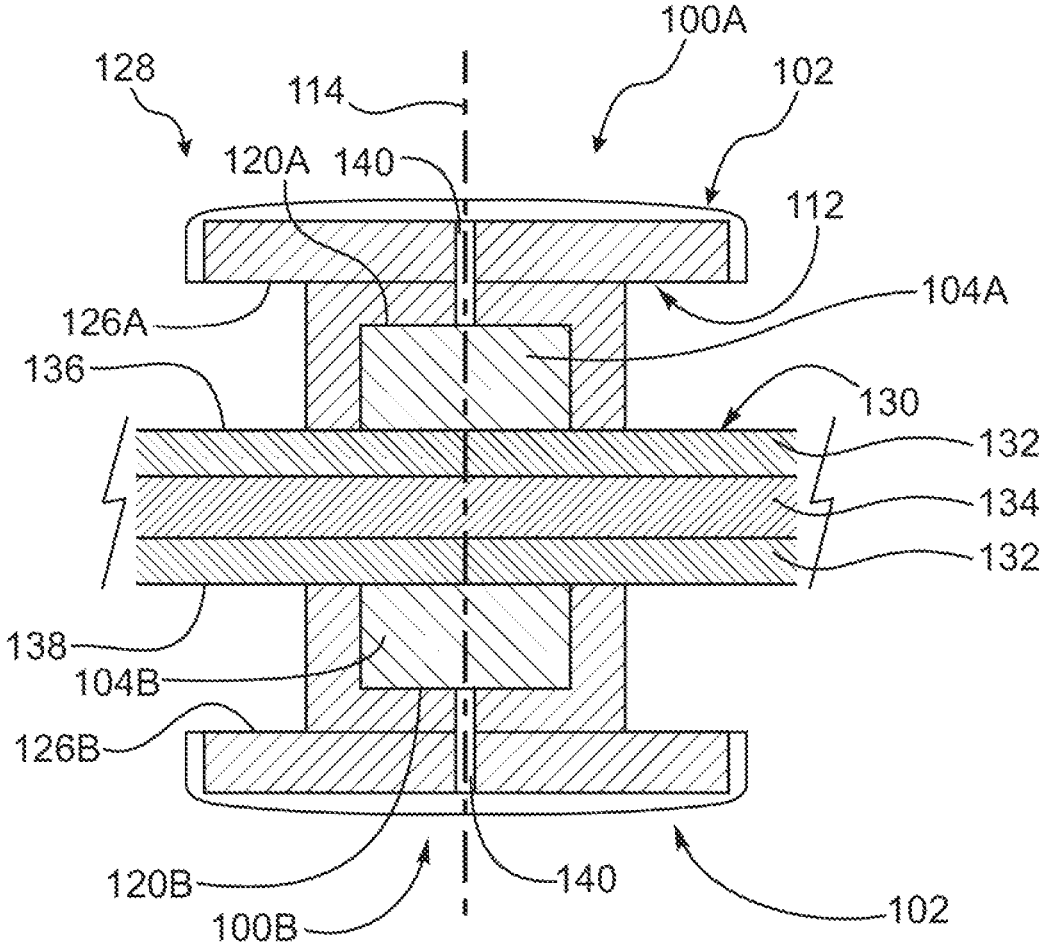

FIG. 5 is a side view of linen fastening assembly 128 in use. In one embodiment, two fasteners 100 are used to engage layered linens, for example, assembly 128 includes fasters 100A and 100B clamping layered lines 130. In the discussion that follows, layered linens 130 are formed by duvet cover 132 and duvet insert 134; however, it should be understood that assembly 128 can be used with any combination of stacked bed linens. In the discussion that follows, cavities 120A and 120B are not fully enclosed, for example, as shown in FIGS. 2 and 3. However, it should be understood that one or both of fasteners 100A and 100B could include an enclosed cavity as described for FIG. 4. The magnets in fasteners 100A and 100B are arranged such that the magnets attract each other when fasteners 100A and 100B are disposed as shown in FIG. 5. For example, the south pole of magnet 104A faces opening 120A and the north pole of magnet 104B faces opening 120B. It should be understood that the orientation of the magnets can be reversed.

Fastener 100A is placed against exterior surface 136 of the duvet cover and fastener 100B is placed against oppositely facing exterior surface 138 of the duvet cover. Since fasteners 100A and 100B are configured with oppositely oriented magnetic poles, magnets 104A and 104B are drawn together, for example, the south pole of magnet 104A is drawn to the north pole of magnet 104B, securely clamping cover 132 and insert 134 between fasteners 100A and 100B. Advantageously, the clamping of cover 132 and insert 134 fixes the position of the insert with respect to the cover. Surfaces 126A and 126B provide a gripping surface for pulling fasteners 100A and 100B apart.

The following should be viewed in light of FIGS. 1 and 5, and provides further detail regarding fastener 100. In general, the discussion is applicable to FIG. 4 except as related to side 122. In one embodiment, cap 110 is mushroom shaped. However, it should be understood that other shapes are possible for the cap. Fastener 100 can be made of any material or combination of materials known in the art, including, but not limited to: plastic, polypropylene, vinyl, nylon, rubber, metal, wood, or other organic substances. In one embodiment, the fastener is made of acetal copolymer. The magnet can be secured within cavity 108 by any means known in the art including, but not limited to: a compressive fit within the cavity or use of an adhesive.

In one embodiment, cap 110 includes opening 140. In one embodiment, the opening connects cavity 108 with top surface 142 of the cap. The opening allows air to exit the cavity when the magnet is pushed into the cavity, and the opening can be used later on in the future to add other accoutrements to the hub. Also, opening 140 provides a means of pushing the magnet out of the cavity in order to replace the magnet. In one embodiment, the opening does not extend to the cavity and is used to add accoutrements to the hub.

Any magnet known in the art can be used for magnet 104. In one embodiment, a neodymium magnet with a pull power of approximately 13 pounds is used for magnet 104. In one embodiment, the magnet is 0.5 inches in diameter and is 0.25 inches thick. It should be understood that magnet 104 is not limited to the size or pull power noted above and that other sizes and pull powers are possible.

In one embodiment, surface 142 is at least partially covered with dome-shaped shell 144. In one embodiment, the shell includes a core made of any material known in the art, for example, aluminum, and an outer, for example, fabric layer made of any material, for example, cotton, other natural materials, synthetic materials, or combinations of natural and synthetic materials, known in the art. It should be understood that shell 144 may have other shapes. In one embodiment, the shell is laminated or made out of colored plastic and other various materials. The rounded shape of cap 110 and shell 144 prevent the fastener from snagging linens and/or persons using the fastener. In one embodiment, the outer layer of the shell is white, but the layer can be any color known in the art. In one embodiment, the outer layer is used for decorative purposes, for example, to coordinate with the appearance of the duvet cover. The outer layer can be monogrammed. Small toys and trinkets, bows, and other various accouterments could be added to the outer layer or built on shell 144. In one embodiment (not shown), cap 110 includes an indentation on the top surface (opposite surface 126) forming a lip about the top of the cap, and shell 144 is inserted into the indentation and engages the lip. A diameter of the shell is slightly less than the diameter of the lip such that the lip securely retains the shell.

The following describes an example usage of assembly 128. Duvet insert 134 is placed inside duvet cover 132. Once the duvet cover and insert are aligned at the corners and along the perimeter of the duvet cover, fastener 100A is placed against surface 136 and fastener 100B is placed against surface 138. The magnetic force between magnets 104A and 104B clamp the duvet cover and the duvet insert and prevent the duvet insert from slipping and bunching within the duvet cover.

In one embodiment, fastener 100 is generally cylindrical in shape; however, it should be understood that other shapes and configurations for fastener 100 are possible. For example, one or both of stem 106 and cap 110 could be any combination of square, rectangular, polygonal, ovoid, or generally asymmetrical. In one embodiment (not shown), cavity 108 opens to the top of the cap. In one embodiment (not shown), hub 102 does not include stem 106 and magnet 104 is connected directly to the bottom of cap 110. In one embodiment, stem 106 and cap 110 are separate pieces joined by any means known in the art, including, but not limited to a threaded interface, an interlocking interface, adhesives, or welding. In one embodiment, stem 106 and cap 110 are integrally formed, that is, formed from a single piece of material.

Adornments can be attached to directly to the cap or through opening 140. In one embodiment (not shown), the fastener is in the shape of a small toy or gadget.

Advantageously, fasteners 100 provide an easily used, easily adaptable, and easily configurable means of clamping layered linens to prevent the linens from shifting, bunching, or separating. The fasteners are easily gripped using the cap and the magnets for pairs of the fasteners are self-aligning. The fasteners can be placed at multiple locations about a perimeter for the linens as needed or desired. The fasteners are modular, that is, fasteners can be added or subtracted as needed or desired, for example, according to the number, type, and characteristics of the layered linens. Additional layers can be easily added or layers can be easily removed due to the ease with which fasteners 100 can be engaged and disengaged. The fasteners are easily removed and replaced to facilitate laundering of the layered linens. The fasteners are small enough so as to provide minimal intrusion and can be made decorative. The fasteners do not pierce, puncture, or otherwise damage the layered linens.

Thus, it is seen that the objects of the present disclosure are efficiently obtained, although modifications and changes to the disclosure should be readily apparent to those having ordinary skill in the art, which modifications are intended to be within the spirit and scope of the disclosure as claimed. It also is understood that the foregoing description is illustrative of the present disclosure and should not be considered as limiting. Therefore, other embodiments of the present disclosure are possible without departing from the spirit and scope of the present disclosure.

What we claim is:

1. A linen fastener, comprising:
a hub including:
a longitudinal axis;
a cap; and,
a stem:
extending from the cap in a direction parallel to the longitudinal axis; and,
including:
a cavity; and,
a cylindrical outer surface not extending past the cap in a direction orthogonal to the longitudinal axis; and,
a magnet at least partially disposed within the cavity and including a portion at least partially aligned with the cylindrical outer surface in the direction orthogonal to the longitudinal axis, wherein:
the hub is arranged to be placed against a first exterior surface of layered linens such that magnetic force from the magnet engages an element located on a second exterior surface of the layered linens, opposite the first exterior surface, to clamp the layered linens between the hub and the element; and,
the longitudinal axis passes through the cap, the stem, and the magnet.

2. The linen fastener of claim 1, wherein:
the stem includes:
at least one axial surface substantially parallel to the longitudinal axis and forming at least a portion of the cavity; and,
a distal surface substantially orthogonal to the longitudinal axis, directly connected to the at least one axial surface, and continuous with the at least one axial surface; and,
the distal surface is arranged to be placed against the first exterior surface of the layered linens.

3. The linen fastener of claim 1, wherein:
the stem includes at least one axial surface substantially parallel to the longitudinal axis and facing away from the longitudinal axis; and,
the lip includes a radial surface substantially orthogonal to the longitudinal axis and extending from the at least one axial surface.

4. A duvet cover fastening assembly, comprising:
a first duvet cover fastener including:
a first hub with: a first stem; a first cavity within the first stem; and a first lip extending from the first stem;
a first magnet disposed within the first cavity; and,
a first outer surface including respective portions of the first stem, the first lip, and the first magnet; and,
a second duvet cover fastener including:
a second hub with: a second stem; a second cavity within the second stem; and a second lip extending from the second stem;
a second magnet disposed within the second; and,
a second outer surface including respective portions of the second stem, the second lip, and the second magnet, wherein:
the first magnet is arranged to be placed against a first exterior surface of a duvet cover encasing a duvet insert; and,
the second magnet is arranged to be placed against a second exterior surface of the duvet cover such that the first and second magnets are drawn toward each other by respective magnetic forces to clamp the duvet cover and duvet insert between the first and second duvet cover fasteners.

5. A linen fastener, comprising:
a hub including:
a longitudinal axis;
a cap; and,
a stem extending from the cap in a first direction parallel to the longitudinal axis; and including:
a cylindrical outer surface at a uniform distance from the longitudinal axis; and,
a cavity wholly bounded by material forming the stem; and,
a magnet disposed within the cavity such that at least a portion of the magnet is aligned with the cylindrical outer surface in a direction orthogonal to the longitudinal axis, wherein:
no portion of the hub extends beyond the cap in a second direction orthogonal to the longitudinal axis;
all of the magnet is aligned with the stem in the first direction;

the hub is arranged to be placed against a first exterior surface of layered linens such that magnetic force from the magnet engages an element located on a second exterior surface of the layered linens, opposite the first exterior surface, to clamp the layered linens between the hub and the element; and, the longitudinal axis passes through the cap, the stem, and the magnet.

* * * * *